US005547200A

United States Patent [19]

Rangel

[11] Patent Number: 5,547,200

[45] Date of Patent: Aug. 20, 1996

[54] ARROW NOCK AND SHAFT INSERT

[76] Inventor: Louis Rangel, 11 N. 3175 East, Layton, Utah 84040

[21] Appl. No.: 418,131

[22] Filed: Apr. 6, 1995

Related U.S. Application Data

[63] Continuation of Ser. No. 242,179, May 13, 1994, abandoned, which is a continuation-in-part of Ser. No. 180,220, Jan. 12, 1994, abandoned.

[51] Int. Cl.[6] ..... F42B 6/06

[52] U.S. Cl. ..... 273/416; 403/282; 403/343; 403/375

[58] Field of Search ..... 273/416, 419–422; 403/375, 398, 359, 343, 282; 411/455

[56] References Cited

U.S. PATENT DOCUMENTS

| | | | |
|---|---|---|---|
| 3,076,217 | 2/1963 | Scholl | 403/343 X |
| 3,182,345 | 5/1965 | Smith | 403/375 X |
| 4,029,319 | 6/1977 | Christen | 273/106.5 R |
| 4,050,696 | 9/1977 | Troncoso, Jr. | 273/420 |
| 4,141,554 | 2/1979 | Sherwin | 273/106.5 R |
| 4,381,866 | 5/1983 | Simo | 273/422 |
| 4,504,063 | 3/1985 | LeBus | 273/422 |
| 4,533,146 | 8/1985 | Schaar | 273/422 |
| 4,722,531 | 2/1988 | Schram | 273/416 |
| 4,781,386 | 11/1988 | Armitage | 273/420 |
| 4,943,067 | 7/1990 | Saunders et al. | 273/416 |
| 5,067,731 | 11/1991 | Bickel | 273/416 |
| 5,094,463 | 3/1992 | Dryden | 273/416 |
| 5,290,044 | 3/1994 | Easton et al. | 273/416 |
| 5,306,019 | 4/1994 | Guest et al. | 273/416 |
| 5,306,020 | 4/1994 | Bolf | 273/416 |

FOREIGN PATENT DOCUMENTS

| | | | |
|---|---|---|---|
| 3447318 | 7/1986 | Germany | 273/416 |
| 256380 | 8/1926 | United Kingdom | 403/282 |
| 2187785 | 9/1987 | United Kingdom | 403/298 |
| 2221740 | 2/1990 | United Kingdom | 403/298 |

OTHER PUBLICATIONS

Brochure, *Archery*, Easton, 1993–94 edition.

*Primary Examiner*—Paul E. Shapiro
*Attorney, Agent, or Firm*—Workman, Nydegger & Seeley

[57] ABSTRACT

A nock system including an insert and a nock. The insert having an introduction end, a receiving end located opposite the introduction end, a substantially cylindrical body extending from the receiving end to the introduction end, and a receiving chamber having an opening at the receiving end and extending a distance into the cylindrical body. The receiving chamber is axially aligned and communicates with a threaded duct which extends farther through the cylindrical body toward the introduction end. The nock comprises a string receiving end for receiving a bow string and an engaging shank located opposite the string receiving end. The engagement shank has a shape and size permitting self-tapping, threaded engagement between the engaging shank and the threaded duct. A compression shank extends between the furrowed end and the engaging shank. The compression shank has a shape and size to produce a friction fit within the receiving chamber as the engaging shank is positioned within the threaded duct.

6 Claims, 2 Drawing Sheets

ARROW NOCK AND SHAFT INSERT

This application is a continuation of U.S. application Ser. No. 08/242,179, filed May 13, 1994, for ARROW NOCK AND SHAFT INSERT, abandoned, which is a continuation-in-part of U.S. application Ser. No. 08/180,220, filed Jan. 12, 1994, now abandoned.

BACKGROUND

1. Field of the Invention

The present invention relates generally to the field of archery and, more specifically, to a nock system capable of selectively securing a nock into the nock end of a hollow arrow shaft.

2. Related Applications

This application is a continuation-in-part of copending application Ser. No. 08/180,220, entitled "Dual-Purpose Arrow Shaft Insert," filed Jan. 1, 1994, in the name of Louis Rangel.

3. Background Art

Archery has served to provide sustenance and recreation since prehistoric times. Today, however, the carved wooden arrows of the past have been replaced by highly refined arrows made of light-weight, high-strength alloys and composites.

Modern arrow shafts are hollow and made of aluminum, fiberglass, graphite, or carbon materials. Attached to the leading end or point end of the shaft is a point. Radially extending near the opposing or nock end of the shaft are fletchings or vanes which give the shaft stability in flight. The fletching comprises a plurality of equally spaced extensions made of feathers or synthetic materials. Secured to the trailing end or nock end of the shaft is a nock for receiving the bow string. While refinement of the arrow has improved accuracy, improvements have also wrought problems.

For example, to attach the nock, the majority of arrows utilize a glue-in insert from which projects a swage. A nock having a hollow end corresponding in size and shape to the swage is then glued over the swage and permanently bonded. The problem with this system, however, is that the nock cannot be rotated or "indexed" after it is glued onto the swage. Nocks must be rotated or "indexed" with respect to the nock insert in order to obtain optimum flight characteristics when the arrow is released from the bow. During passage of the arrow over an arrow rest, portions of the fletching of the arrow come in contact with the arrow rest. By indexing the nock, the contact between the fletching and the arrow rest of the bow can be minimized to reduce the affect of the contact on the flight path of the arrow.

An additional problem with having the nock glued to the swage is that it is difficult to remove and replace the nock. In archery competitions, an arrow will often strike a previously lodged arrow and deform or break the nock of that arrow. In order to reuse the arrow shaft, it is desirable to be able to quickly remove the broken nock and replace it with a new one. This is difficult when the nock is glued to the swage.

To overcome these problems, tubular inserts having a receiving chamber have been developed. The insert is secured (typically glued) into the arrow shaft. A nock having a shank with a diameter complementary to the receiving chamber is then press-fit into the insert. Using this system, a nock is capable of being indexed by rotating the nock to overcome the friction between the nock and the insert.

Although this system overcomes some problems, additional drawbacks are encountered.

When the nock is inserted into the arrow shaft, even slight variations in the longitudinal axis of the nock in relation to the longitudinal axis of the arrow shaft can result in an inaccurate flight path. Because of the substantial impact which the point of a modern arrow undergoes due to higher flight speeds, vibration from the impact travels through the shaft and into the nock insert causing the nock to work loose. As the nock vibrates loose, the nock may alter the flight path of the arrow during subsequent flights.

Furthermore, since the nock is only secured to the hock insert by frictional forces resulting from press fitting, vibrations, indexing, and replacing of the nock can wear down the shaft of the nock resulting in the nock being loosely fitted. As such, the nock can be easily misaligned and thereby affect the flight path of the arrow.

As an additional limitation, nock inserts capable of receiving press-fit nocks do not have any internal surfaces which can easily be gripped to remove the nock insert from the shaft. Archers wishing to salvage nock inserts from damaged arrows must attempt to remove the nock insert by heating the glue and removing the insert from the heated arrow with pliers. Unfortunately, the pressure required to remove the nock insert often results in deformation of the nock insert and shaft due to the pressure which must be applied by the pliers.

The current adhesive systems for attaching the insert to the arrow shaft are also cumbersome. The user must heat a heat-sensitive adhesive stick and then paint the adhesive onto the insert prior to pressing the insert into the arrow shaft. Typically, a portion of the glue or adhesive is scraped off as the insert is pressed into the arrow shaft. This results in uneven application of the adhesive and premature failure of the joint.

To increase the accuracy of an arrow, archers also consider the weight balance and type of fletching. For example, if the fletching on an arrow is changed from feathers to plastic vanes, the balance of the arrow will be altered by the heavier plastic vanes. The weight of the point and the nock insert will also affect the balance of the arrow. Although some bias toward the front of the arrow is desirable, too much bias in that direction may result in an arrow which has an erratic flight path.

During competition, the similarity of nock colors and fletching may make it difficult to determine which arrows belong to which competitor. It becomes important to distinguish arrows when adjustments to the trajectory of subsequent shots is desired. This can be overcome by changing the nock in the arrow to a distinctive color. Archers in competitions are hesitant to change nocks, however, because of the chance that a replacement nock will not seat properly and will upset the trajectory of the arrow.

BRIEF SUMMARY AND OBJECTS OF THE INVENTION

It is, therefore, an object of the present invention to provide a nock and insert that will permit indexing of the nock.

Another object of the present invention is to provide a nock and insert as discussed above in which the nock is capable of being easily removed and replaced.

Still another object of the present invention is to provide a nock and insert with which the nock can remain securely attached to the insert after indexing and repeated shots.

A further object of the present invention is to provide an insert which can be easily altered to change the weight of the insert thereby assisting in balancing an arrow.

A still further object of the present invention is to provide an insert which aids in the application of an even coating of adhesive.

Yet another object of the present invention is to provide an insert which can be easily removed from the arrow shaft without damaging the insert or shaft.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, an arrow nock and shaft insert is provided for positioning a nock into the nock end of a hollow arrow shaft. The insert has an introduction end, a receiving end located opposite the introduction end, and a substantially cylindrical body extending from the receiving end to the introduction end. Positioned at the receiving end of the insert is a beveled head having an insert shoulder that acts as a stop during positing of the insert. To facilitate positioning, the insert is slid within the hollow arrow shaft until the nock shoulder engages against the nock end of the arrow shaft.

Also formed at the receiving end of the insert is an opening for a cylindrical receiving chamber that extends to a sloped transition shoulder positioned within the cylindrical body. Axially aligned and communicating with the receiving chamber is a threaded duct that extends from the transition shoulder to the introduction end. The diameter of the threaded duct is smaller than the diameter of the receiving chamber.

In one embodiment, adhesive grooves can be circumferentially formed about the exterior of the cylindrical body at a position over the threaded duct. The adhesive grooves can serve several functions. One function of the adhesive grooves is to retain and help spread a quantity of adhesive between the cylindrical body and the arrow shaft as the insert is positioned within the arrow shaft.

The adhesive grooves can also be used to help balance an arrow. The innermost point of the adhesive groove forms a break point that is in close proximity to the threaded duct. As a result, a weak area is produced at the break point which allows a segment of the insert to be snapped off and disposed of. By selectively removing segments, the weight of the arrow can be properly balanced.

The nock system further includes a nock having a string receiving end for receiving a bow string, an engaging shank located opposite the string receiving end, and a compression shank extending between the string receiving end and the engaging shank.

The engaging shank has a diameter complementary to but slightly larger than the diameter of the threaded duct. The nock, and especially the engaging shank, is preferably made of a material such as plastic which is capable of self-tapping into the threaded duct. The material should also possess sufficient memory or resiliency to expand within the threaded duct and the remainder of the insert so that the nock will not readily move after initial indexing. As the nock is inserted into the receiving chamber, the nock can be selectively rotated to self-tap the engaging shank into the threaded duct. The nock can also be indexed while the nock is being secured to the insert.

The compression shank has a shape complementary to the shape of the receiving chamber and is sized so as to produce a friction fit between the compression shank and receiving chamber. In one embodiment, compression knobs can be positioned on the compression shank. The compression knobs compress on being inserted into receiving the chamber and then expand to hold the nock by friction.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 1:
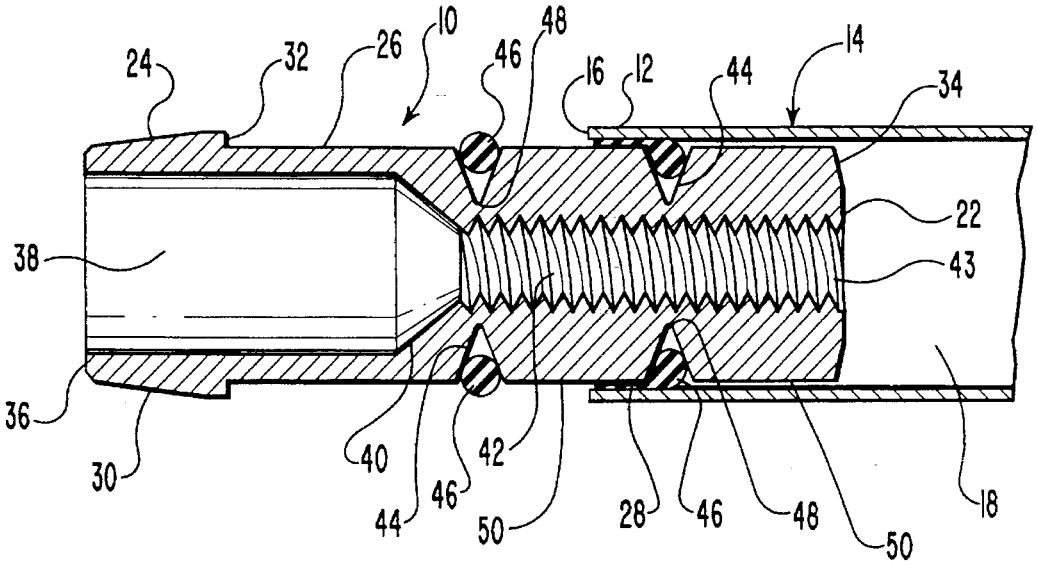
FIG. 1 is a cross-sectional view showing an insert being partially inserted into the nock end of a hollow arrow shaft.

Referring to FIG. 1, an insert 10 is shown partially inserted into a nock end 12 of a hollow arrow shaft 14. Formed at nock end 12 of shaft 14 is a lip 16 that defines the perimeter of a passageway 18 that extends the length of shaft 14.

Insert 10 has an introduction end 22, a receiving end 24 located opposite introduction end 22, and a substantially cylindrical body 26 extending from introduction end 22 to receiving end 24. Introduction end 22 of cylindrical body 26 has a shape complementary to passageway 18 and is sized to permit introduction end 22 to be snugly fit within passageway 18. In the preferred embodiment, introduction end 22 is sized to permit a thin film of adhesive 28 to be positioned between passageway 18 and cylindrical body 26. Adhesive 28 is used to securely maintain insert 10 within passageway 18.

Extending from receiving end 24 a distance toward introduction end 22 is a beveled head 30 that gradually increases in diameter until reaching an insert shoulder 32 that abruptly drops off. During positioning of insert 10 into shaft 14, insert shoulder 32 serves as a stop to halt the progress of insert 10 by engaging against lip 16 of shaft 14. Insert shoulder 32 and lip 16 are sized to permit a smooth surface transition between insert 10 and shaft 14, thereby avoiding additional air drag and preventing snagging. Introduction end 22 also has a taper 34 which serves to aid in the insertion of introduction end 22 into arrow shaft 14.

Still referring to insert 10, formed at receiving end 24 is an opening 36 for a cylindrical receiving chamber 38 that extends to a sloped transition shoulder 40 positioned within cylindrical body 26. Axially aligned and communicating with receiving chamber 38 is a threaded duct 42 having threads 43. Threaded duct 42 extends from transition shoulder 40 to introduction end 22. The diameter of threaded duct 42 is smaller than the diameter of receiving chamber 38.

Unlike conventional friction inserts, the formation of threaded duct 42 provides a threaded surface for easy attachment and removal of insert 10. For example, as disclosed in copending patent application Ser. No. 08/181,171, entitled "Multi-Purpose Arrow Assembly Tool," filed Jan. 12, 1994, in the name of Louis Rangel, a tool is provided having a threaded end that can be screwed into threaded duct 42. The tool can then be used to pull insert 10 from shaft 14. This is a significant advancement over the past methods of removing inserts with plugs.

In the embodiment illustrated in FIG. 1, two adhesive grooves 44 are circumferentially formed about cylindrical body 26 so as to be over threaded duct 42. Adhesive grooves 44 serve several functions. The first function of adhesive grooves 44 is to retain a quantity of adhesive 28 as cylindrical body 26 is pressed into arrow shaft 14. Because of the close fit between insert 10 and arrow shaft 14, only a very thin layer of adhesive 28 remains and the rest of adhesive 28 is scraped away. By maintaining a quantity of adhesive 28 in adhesive grooves 44, adhesive grooves 44 serve as a reservoir to apply a thin layer of adhesive 28 as insert 10 travels into passageway 18.

Another function of adhesive grooves 44 is to hold adhesive O-rings 44 during shipment or during heating of O-rings 44 prior to positioning of insert 10. For example, as illustrated in FIG. 1, when a user wishes to position insert 10 into arrow shaft 14, adhesive O-rings 46 are placed into adhesive grooves 44. Insert 10 and adhesive O-rings 46 are then heated. (Arrow shaft 14 is also warmed to prevent shock and deformation.) Insert 10 is then pressed into arrow shaft 14. As arrow shaft 14 makes contact with adhesive O-ring 46, an even layer of adhesive 28 is spread between insert 10 and arrow shaft 14. FIG. 1 illustrates the reservoir function of one of adhesive O-rings 46 after partially being pressed into arrow shaft 14. The remaining adhesive 0-ring 46 is illustrated in an unheated state.

This even application of adhesive should be contrasted with the typical methods of applying archery adhesive. For example, most archers are required to purchase adhesive in a stick which then must be heated, melted, and painted onto an insert just prior to pressing of the insert into an arrow shaft. Painting or dipping of adhesive often results in uneven applications of adhesive which result in poor bond strength.

A further purpose of adhesive grooves 44 may be seen when balancing an arrow. The innermost point of adhesive groove forms a break point 48 that is in close proximity to threaded duct 42. As a result, a frangible area is produced at break point 48 which allows a segment 50 of insert 10 between break point 48 and introduction end 22 to be snapped off and disposed of. By selectively removing a segment 50, which in turn affects the weight of insert 10, an arrow can be properly balanced. In the preferred embodiment, a plurality of adhesive grooves 44 are positioned on cylindrical body 26, thereby forming a plurality of segments 50 that can be easily and selectively removed for balancing an arrow. Furthermore, adhesive grooves 44 can be selectively positioned during formation of insert 10 to produce segments 50 of a desired weight.

The same insert 10 illustrated in FIG. 1 can be utilized as a point insert. Disclosure of the use of insert 10 as a point insert along with additional design and functional aspects of insert 10 are found in copending U.S. Pat. application Ser. No. 08/180,220 entitled "Dual-Purpose Arrow Shaft Insert," filed Jan. 1, 1994, in the name of Louis Rangel which is incorporated herein by specific reference.

Figure 2:
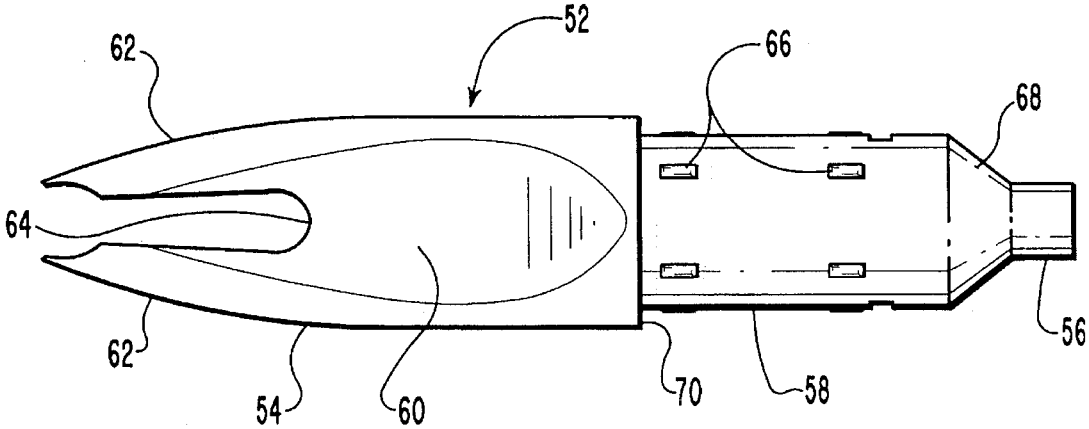
FIG. 2 is a perspective view of a nock.

As depicted in FIG. 2, the present invention also discloses a nock 52 for attachment to insert 10. As used in the specification and appended claims, the term "nock system" is intended to include the combination of nock 52 and insert 10. Nock 52 includes a string receiving end 54, an engaging shank 56 located opposite string receiving end 54, and a compression shank 58 extending between string receiving end 54 and engaging shank 56.

String receiving end 54 is defined by a finger platform 60 having parallel nock wings 62 extending therefrom. Positioned between nock wings 62 is a groove 64 for receiving a bow string (not shown).

Engaging shank 56 has a diameter complementary to but slightly larger than the diameter of threaded duct 42. Preferably nock 52, and especially engaging shank 56, is made of a material capable of being self-tapping. By way of example and not by limitation, most plastic materials including polycarbonate and buterite can be used. The most preferred materials are those having memory capability. As used in the specification and appended claims, the term "memory material" means that the material can be deformed under any outside force and then later return to is original shape without the application of any outside force. Accordingly, as nock 52 is inserted into receiving chamber 38, nock 52 can be selectively rotated to self-tap engaging shank 56 into threaded duct 42 to create threads along the smooth sides of engaging shank 56, thereby securing nock 52 into insert 10.

Compression shank 58 has a shape complementary to the shape of receiving chamber 38 and is sized so as to produce a uniform friction fit between compression shank 58 and receiving chamber 38. Where nock 52 is made of a relatively soft memory material, the diameter of compression shank 58 can be slightly larger than the diameter of receiving chamber 38. Such a design will permit compression shank 58 to compress as compression shank 58 is inserted into receiving chamber 38 and then expand to press against receiving chamber 38, thereby producing a friction fit. In an alternative embodiment as shown in FIG. 2, compression knobs 66 can be positioned on compression shank 58. Knobs 66 compress on being inserted into receiving chamber 38 and then expanding to hold nock 52 by friction.

Compression shank 58 is connected to engaging shank 56 by a sloped nock shoulder 68 that is complementary to transition shoulder 40 in insert 10. Nock shoulder 68 helps to feed compression shank 58 into receiving chamber 38, insures that nock 52 is properly centered in receiving chamber 38, and adds additional friction surface for holding nock 52 secure in receiving chamber 38. Compression shank 58 is connected to string receiving end 54 by a radial shoulder 70 that projects from compression shank 58. Radial shoulder 70 engages against opening 36 of insert 10 to act as a stop when nock 52 is properly positioned in insert 10. Radial shoulder 70 and opening 36 are complementary sized so as to produce a smooth transitional surface between nock 52 and insert 10, thereby avoiding unnecessary air drag.

Figure 3:
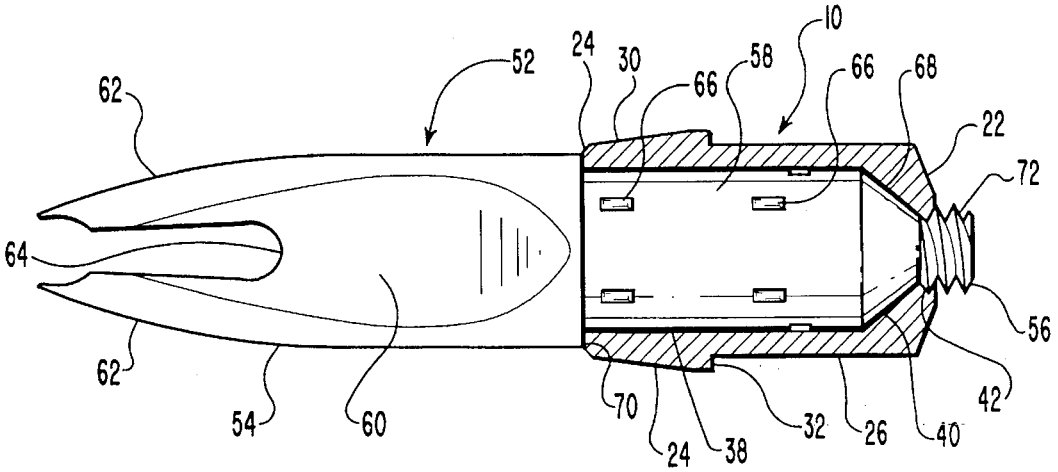
FIG. 3 is a cross-sectional view of the nock in FIG. 2 secured within an insert.

One of the novel features of the present invention is the ability to index nock 52 after nock 52 has been positioned and secured within insert 10. As illustrated in FIG. 3, proper positioning of nock 52 requires nock 52 to be inserted and rotated within receiving chamber 38 so that threads 72 are self-tapped into engaging shank 56 as engaging shank 56 is threaded into threaded duct 42. As engaging shank 56 is self-tapped into threaded duct 42, nock 10 advances until radial shoulder 70 engages against opening 36 of insert 10. At times, however, it is necessary to further rotate or index the nock so that the fletching (not shown) is properly aligned with the bow (not shown).

By manufacturing nock 52 out of a memory material, it is possible to index nock 52 and still have threaded duct 42 hold nock 52 securely in insert 10. It is believed that as nock 52 is rotated past the point where radial shoulder 70 and opening 36 meet, self-tapped threads 72 partially compress and flow over threads 43 on threaded duct 42. Once nock 52 is properly indexed, self-tapped threads 72 expand, securely holding nock 52 within insert 10.

Depicted in FIG. 3, insert 10 is shown absent segments 50. Insert 10 can either be produced in this shape or formed by selectively removing segments 50. Attachment of nock 52 into insert 10 shown in the embodiment of FIG. 3 has additional advantages for securing nock 52 after nock 52 has been indexed.

As shown in FIG. 3, once nock 52 has been positioned into insert 10, a portion of self-tapped threads 72 extend beyond threaded duct 42. As nock 52 is indexed, exposed threads 72 may be stripped at the point of contact with the portion of the frangible area left exposed by removing a segment. Accordingly, once nock 52 is finally indexed, exposed threads 72 may also act as a deterrent to the backing out of the nock from the insert by engaging against the end of threaded duct 42, thereby preventing longitudinal but not radial movement of the nock.

When the nock is fully secured within an insert having several segments instead of the single segment arrangement of FIG. 3, engaging shank 56 is pressed and rotated into threaded duct 42 of the first segment and threads are formed along the seam sides of engaging shank 56. After initial passage through the portion of threaded duct 42 in the first segment, the threads serve to pull the remainder of the hock until compression shank 58 is within receiving chamber 38 and radial shoulder 70 engages against opening 36 of insert 10.

One of the benefits of the pulling action of the self-tapped engaging shank is that the hock is self-centering. This results in a nock which will be concentric with the arrow shaft and will not affect the trajectory of the arrow in its flight path. This is in distinction to a nock which has been pushed in rather than pushed and pulled as a nock that is simply pushed in can be pushed in at an angle and not properly seated.

Figure 4:
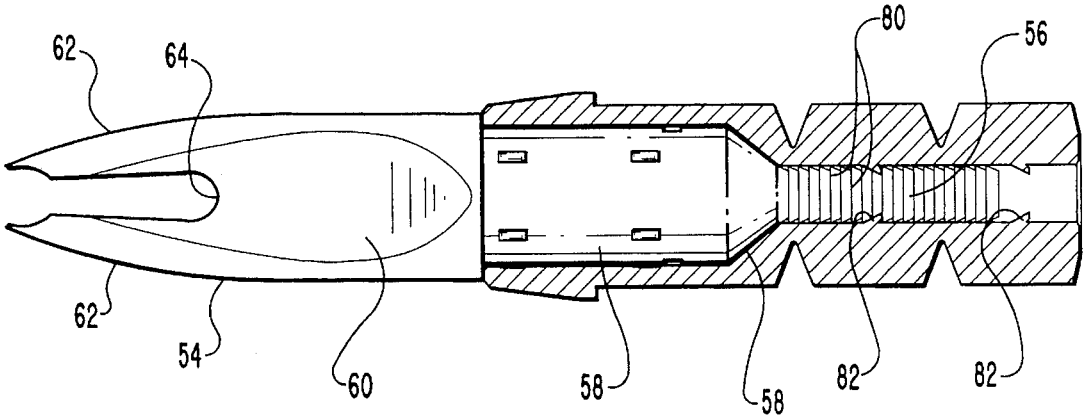
FIG. 4 is a cross-sectional view of an alternate embodiment employing serrations and cogs.

Referring now to FIG. 4, an alternate embodiment of the present invention is illustrated having means for securing the nock into the insert, the means being positioned at a point forward of the compression shank 58. While the prior art relies on the friction between compression shank 58 and the insert to maintain the nock within the insert, the means for securing the nock in the insert in the present invention provides a secondary securing mechanism to resist the tendency of the nock to become loose due to vibration from impact.

Although the embodiments of the present invention illustrated in FIGS. 1–4 utilize a small engaging shank 56 which becomes threaded after passing through the threaded duct 42, the embodiment illustrated in FIG. 5 utilizes an engaging shank 56 which has a series of teeth or serrations formed about its exterior surface. The serrations are pressed past cogs 82 which are formed within a duct 84 located in the same position where threaded duct 42 would normally be. Cogs 82 deflect out of the path of shank 56 and serrations 80 when the nock is being pressed in the insert.

After insertion, however, cogs 82 cause friction against serations 80 to make removal of the nock difficult. This resistance can be overcome by utilizing a tool to apply longitudinal force to the nock. The resistance imparted by cogs 82 is sufficient to resist inadvertent loosening or removal of the nock from the insert during typical usage but not so resistant that the nock cannot be removed.

It will be appreciated by those skilled in the art that other mechanical securing systems can be utilized on shank 56 to produce additional friction between the shank and the duct. Although only two embodiments have been illustrated, other embodiments utilizing securing systems presently known to those skilled in the art also fall within the scope of the claims.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A nock for attachment to the nock end of a hollow arrow shaft via an insert, the insert having an introduction end, a receiving end located opposite the introduction end, a substantially cylindrical body extending from the receiving end to the introduction end, and a receiving chamber having an opening at the receiving end and extending a distance into the cylindrical body, the receiving chamber being axially aligned and communicating with a threaded duct which extends farther through the cylindrical body toward the introduction end, the nock comprising:

a) a string receiving end for receiving a bow string;

b) an engaging shank located opposite the string receiving end, the engaging shank having a size and shape to permit threaded engaging between the engaging shank and the threaded duct; and c) a compression shank extending between the string receiving end and the engaging shank, the compression shank having a size and shape for insertion into the receiving chamber to produce a friction fit therewith, the compression shank further having an exterior surface with compression knobs formed thereon.

2. A nock for attachment to the nock end of a hollow arrow shaft via an insert as defined in claim 1, wherein the engaging shank has a diameter smaller than the compression shank.

3. A nock for attachment to the nock end of a hollow arrow shaft via an insert as defined in claim 2, further comprising a sloped transition shoulder extending between the compression shank and the engaging shank.

4. A nock for attachment to the nock end of a hollow arrow shaft via an insert as defined in claim 1, wherein the nock is made from a memory material.

5. A nock for attachment to the tail end of a hollow arrow shaft via an insert as defined in claim 1, where the nock is made of a polycarbonate material.

6. A nock system for insertion into the nock end of a hollow arrow shaft, the nock system comprising:

a. a nock including:

i) a string receiving end for receiving a bow string;

ii) an engaging shank located opposite the string receiving end, the engaging shank being substantially cylindrical, made of a memory material and having a smooth exterior surface and a diameter; and iii) a compression shank extending between the string receiving end and the engaging shank, the compression shank having a diameter larger than the diameter of the engaging shank and having compression knobs formed thereon; and b. an insert including:

i) an introduction end;

ii) a receiving end located opposite the introduction end;

iii) a substantially cylindrical body extending from the receiving end to the introduction end;

iv) a receiving chamber having an opening at the receiving end and extending a distance into the cylindrical body, the receiving chamber also having a diameter complementary to the diameter of the compression shank to produce a fiction fit therewith; and v) a threaded duct being axially aligned and communicating with the receiving chamber, the threaded duct extending from the receiving chamber toward the introduction end and having a diameter, the diameter of the engaging shank being slightly larger than the diameter of the threaded duct.

* * * * *